United States Patent [19]

Satzler

[11] 4,360,312

[45] Nov. 23, 1982

[54] SCRAP REMOVAL APPARATUS

[75] Inventor: Ronald L. Satzler, Princeville, Ill.

[73] Assignee: Caterpillar Tractor Co., Peoria, Ill.

[21] Appl. No.: 250,750

[22] PCT Filed: Jun. 23, 1980

[86] PCT No.: PCT/US80/00781

§ 371 Date: Jun. 23, 1980

§ 102(e) Date: Jun. 23, 1980

[87] PCT Pub. No.: WO82/00027

PCT Pub. Date: Jan. 7, 1982

[51] Int. Cl.[3] ..... B65H 29/08

[52] U.S. Cl. ..... 414/741; 414/740; 414/226; 414/744 A

[58] Field of Search ..... 294/103 R, 104; 414/226, 740, 738, 729, 744 A, 120, 753, 741; 425/86, 215

[56] References Cited

U.S. PATENT DOCUMENTS

| | | | |
|---|---|---|---|
| 2,943,750 | 7/1960 | Sehn | 294/104 X |
| 3,640,405 | 2/1972 | Carpenter, Jr. | 414/740 |
| 3,884,363 | 5/1975 | Ajlouny | 294/103 R X |
| 4,266,910 | 5/1981 | Pickard | 414/740 X |

*Primary Examiner*—Douglas C. Butler
*Assistant Examiner*—Terrance L. Siemens
*Attorney, Agent, or Firm*—Wegner, Stellman, McCord, Wood & Dalton

[57] ABSTRACT

A scrap removal apparatus (35) for retrieving scrap material (32,33) from a two-piece table (19) includes a programmed lift arm assembly (37) movable between the table (19) and scrap accumulating areas (82,83) and has remotely actuable mechanical gripping devices (45) for positively clamping onto the scrap material (32,33). One form of gripping device is a clamp (50) having a finger (57) and an enlarged pad (54), the fingers (57) of the respective clamps (50) movable through slots (70) defined in the outer table edge (21) to grip the overlying outer scrap (32). Another form of gripping device includes a blade (80) for pinning the inner scrap (33) against a stop (73) near the table center.

9 Claims, 6 Drawing Figures

FIG. 1
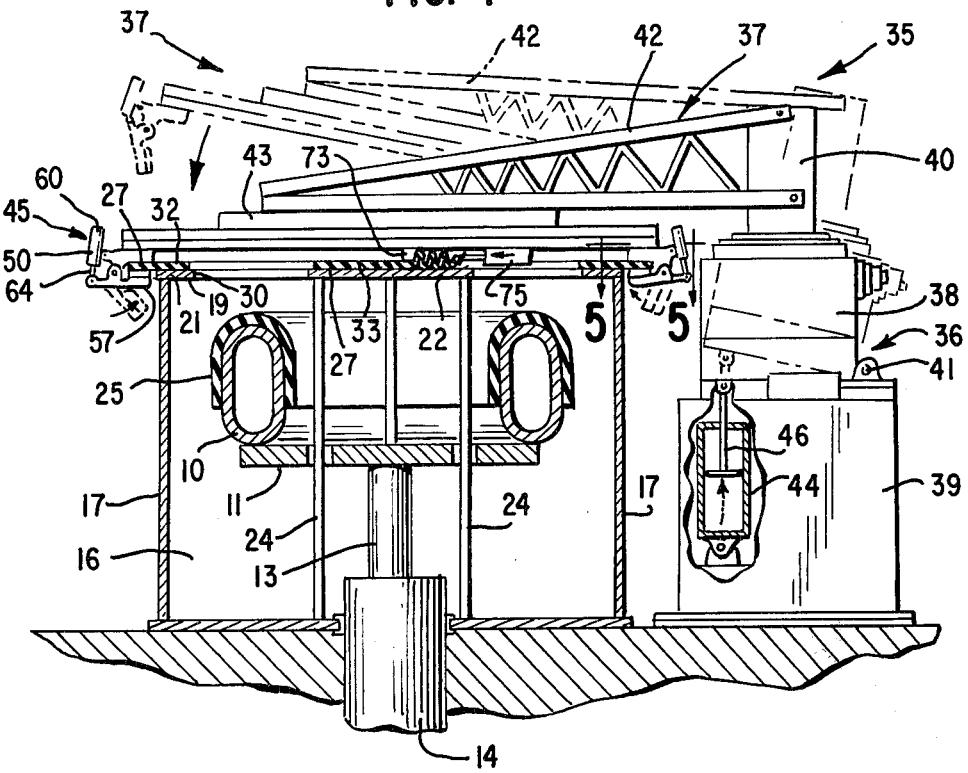
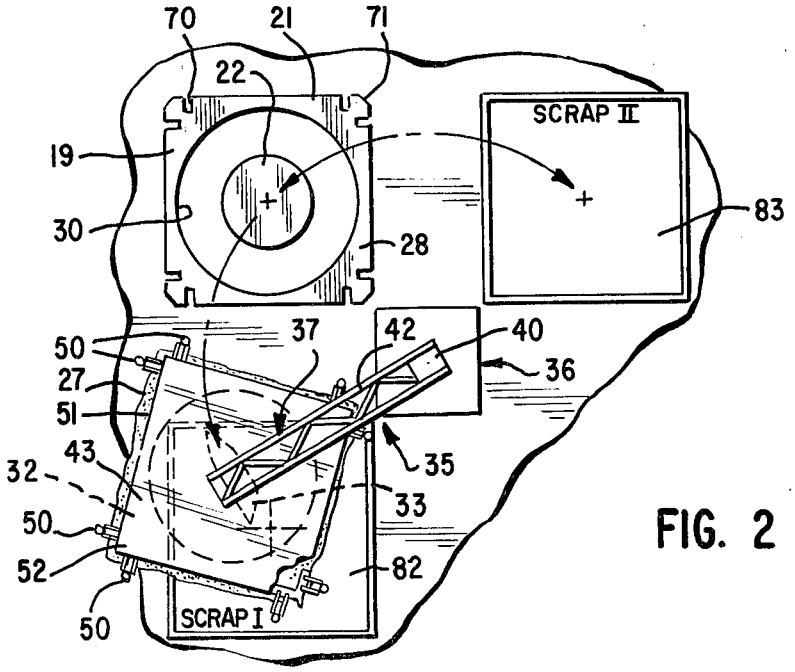
FIG. 2

FIG. 3
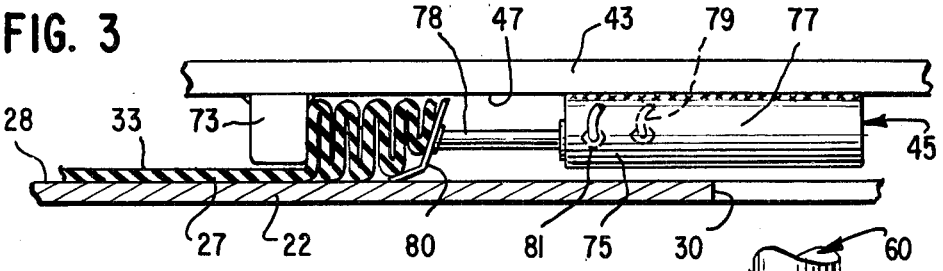
FIG. 4
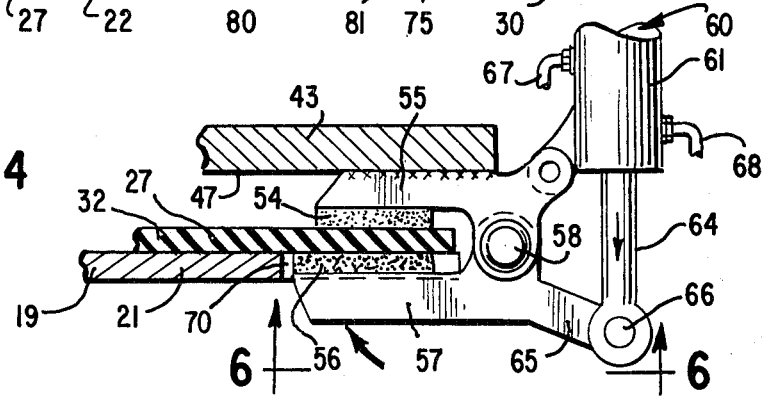
FIG. 5
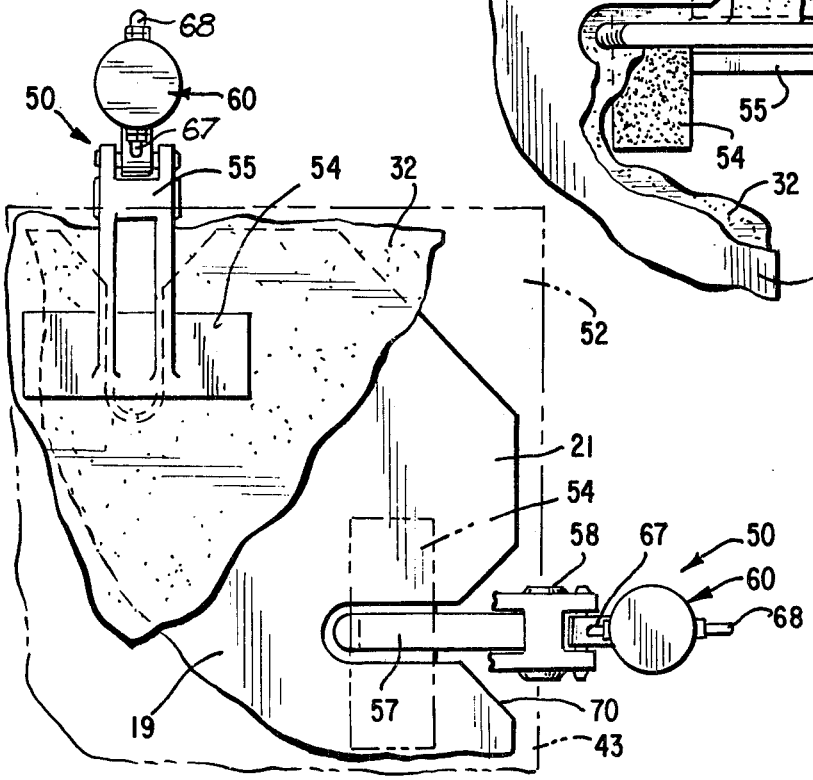
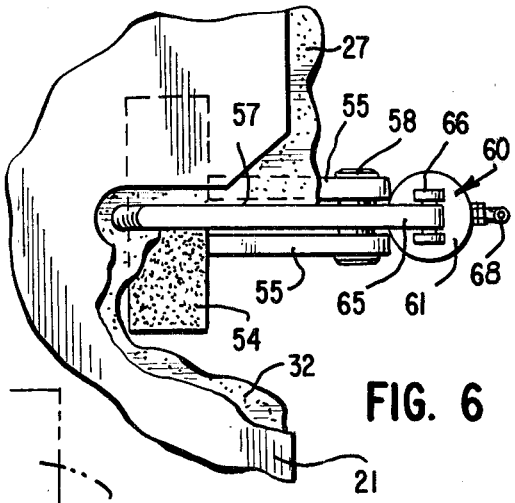
FIG. 6

SCRAP REMOVAL APPARATUS

DESCRIPTION

1. Technical Field

This invention relates generally to an improved apparatus for removing scrap material from a worktable and, more particularly, to an apparatus for removing scrap from inner and outer portions of the top surface of a vacuum chamber and sorting the same.

2. Background Art

In the U.S. Pat. No. 4,053,272 to Charles E. Grawey, issued Oct. 11, 1977, which is assigned to the assignee of this invention, is disclosed an exemplary apparatus for forming on a removable core a tube article made from uncured natural and/or synthetic rubber. A slightly modified apparatus of this type includes a fixed worktable for supporting a sheet of material from which an annular product piece is cut leaving two separate and distinct pieces of scrap material. One piece of scrap remains on an inner table portion and the other piece of scrap remains on a separate outer table portion, which surrounds but is spaced from the inner table portion. Initially, this scrap material had been manually removed.

Devices have since been developed to automatically lift and remove both pieces of scrap from the table by means of a vacuum or suction. However, this type of mechanism has not been entirely satisfactory since the scrap is relatively heavy and of a large size. Such a load dictates that positive mechanical gripping action be employed.

The present invention is directed to overcoming one or more of the problems as set forth above.

DISCLOSURE OF INVENTION

To overcome the problems associated with the prior art constructions, positive clamping devices are employed to retrieve scrap material from the flat worktable and to deposit it in one of the preselected scrap areas.

In accordance with the invention, a scrap removal apparatus is provided with a plurality of remotely actuated air motors which drive gripping mechanisms to a closed position to pin scrap material between the parts thereof. In an exemplary embodiment of the invention, two different gripping mechanisms are carried on a lift arm assembly. One type is a clamp mechanism which employs scissors action to grip the scrap material from above and below when the clamp parts are closed together. The other type employs a blade which pushes the scrap material generally along the table surface and pins the scrap material against a stop.

In one aspect of the invention, the worktable is provided with slots at the outer edges thereof, sized to permit a portion of the clamp mechanism to pass therethrough. The scrap material overlies the slots such that when the clamp parts are closed, a smaller clamp part passes through the slot to effect gripping of the overlying scrap material against an uppermost larger clamping part.

In another aspect of the invention, the lift arm assembly can be pivoted to any of a number of positions after it has been raised from the table to release portions of the scrap material into any of a plurality of separate and distinct scrap accumulating areas.

BRIEF DESCRIPTION OF DRAWINGS

FIG. 1 is a side elevational view partially in section of an exemplary scrap removal apparatus constructed in accordance with the present invention;

FIG. 2 is a top view of the apparatus illustrating the relative locations of a vacuum chamber and at least two scrap accumulating areas;

FIG. 3 is an enlarged, fragmentary side elevational view of the blade and stop gripping device of the apparatus;

FIG. 4 is an enlarged, fragmentary side elevational view of one of the clamp gripping devices shown in FIG. 1;

FIG. 5 is an enlarged, elevational view partially in section of two adjacent clamps taken along line 5—5 of FIG. 1; and FIG. 6 is an enlarged, elevational view of a clamp taken along line 6—6 of FIG. 4.

BEST MODE FOR CARRYING OUT THE INVENTION

Shown in FIG. 1 is a toroidal sand core 10 resting on a support 11 carried by a rod 13 which is extendible and retractable from an air motor 14 for raising and lowering the support 11 and core 10.

The sand core 10 is supported within a vacuum chamber 16 defined by housing upright walls 17 spaced from the core 10 and a flat worktable 19 at the upper end thereof. The table 19 has an outer edge portion 21 extending horizontally outward from the housing walls 17 and a separate inner center portion 22 supported by means, such as vertical rods 24, which extend through the support 11 internally of the core 10.

In preparing to form a portion of a tube 25 on the core 10, a length of uncured elastomeric material 27, such as rubber, is positioned along the upper surface 28 of the table 19 in a manner to close and seal the annular opening 30 at the upper end of the vacuum chamber 16. The elastomeric material sheet 27 may extend beyond the edge portions 21 of the table 19, the table 19 positioning and supporting the material sheet 27 along and parallel to the midcircumferential plane of the sand core 10. At this point, a vacuum is created within the vacuum chamber 16 by suitable means so that atmospheric pressure acts on the outer surface of the sheet of elastomeric material 27 as the core 10 is raised by the power mechanism or air motor 14. In this manner, the sheet 27 is stretched and drawn downwardly so that a portion of the sheet 27 is deposited on the said core 10, preferably, continuously along the inner and outer peripheries of the core 10 a small distance past the mid-circumferential plane of the core 10. The core 10 may advantageously be of porous material so that the vacuum is applied to the material sheet 27 deposited on the core 10 through the porous core thereby pulling the material sheet 27 into tight contact with the core 10.

While the material sheet 27 is held by the vacuum, a cutter and stitcher (not shown) are moved into position to trim the portions of the sheet not disposed on the core 10 away from the portion deposited on the core 10. After the cutter is removed, two separate scrap portions remain, namely, an outer square portion 32 having a round cutout and an inner circular portion 33.

A scrap removal apparatus, broadly designated 35, comprises a power drive mechanism, generally designated 36, for rotatably driving a spindle 40 to which is affixed a lift arm assembly, generally designated 37. The power drive mechanism 36 has a housing 38 which is pivotally mounted by pivot 41 to a base 39 carried by a fixed platform or by the floor. An air motor 44 is mounted in the base 39 and has an extendible rod 46 engaging the under part of the housing 38 at a point remote from the pivot 41. The lift arm assembly 37 is mounted in cantilever fashion to the spindle 40 and generally includes a trussed arm 42, a plate 43 secured to the lower beam of the truss, and a plurality of mechanical gripping devices, collectively designated 45.

As seen in FIG. 1, the lift arm assembly 37 is pinned at two vertically spaced points to the spindle 40 and extends outward therefrom. The lift arm assembly 37 can thus be moved vertically between a lowered position in close proximity to the upper surface 28 of the table 19 and a raised position spaced from the table 19 as shown in phantom. The raising and lowering of the lift arm assembly 37 is accomplished by energizing the air motor 44 to pivot the power drive mechanism 36 and the spindle 40 about the pivot 41 which will raise the arm assembly 37 and plate 43 to the phantom position of FIG. 1. As seen in FIG. 2, the spindle 40 is rotatable about a vertical axis to move the lift arm assembly 37 horizontally to a plurality of locations spaced from the vacuum chamber 16.

After the material sheet 27 has been vacuum formed and cut and the core 10 has been lowered into the vacuum chamber 16, the lift arm assembly 37 is tilted to the raised position and swung from its rest position to a position with the plate 43 over the container 17. The lift arm assembly 37 and plate 43 are then moved to the lowered position by retracting rod 46 into air motor 44. Attached to the underside 47 of the plate 43 are a plurality of fluid driven clamps 50, which comprise a portion of the gripping devices 45. As shown herein, the clamps 50 are located two adjacent each lateral edge 51 of the plate 43 such that two such clamps 50 are located more or less adjacent each plate corner 52. Each of the clamps 50, as shown in FIGS. 4,5,6, includes an enlarged, rectangular flat pad 54 fixed relative to the edge 51 of the plate 43 via bifurcated arm segments 55 which are welded, or the like, to the underside 47 of the plate 43. The clamp 50 includes a thin finger 57 with a pad 56 and is hinged between the arm segments 55 by a pivot pin 58. A fluid or air motor 60 having an air cylinder 61 drives a rod 64 which is connected to arm 65 of the finger 57 by a pivot pin 66. Thus, when rod 64 of the motor 60 is driven to an extended position by introducing pressurized air through conduit 67, the clamp 50 is closed. When air pressure to the motor 60 is delivered through conduit 68, the motor 60 is driven to a retracted position to open the clamp 50. In the open position of the clamps 50, the fingers 57 extend substantially straight down so as to clear the outer edges of the table 19 as the clamp pads 54 of the plate 43 are lowered into contact with the scrap on the table.

To facilitate gripping of the large outer scrap portion 32 by the clamps 50, notches or slots 70 are formed adjacent the corners 71 of the table 19 at a position aligned with the clamp fingers 57 which will not interfere with the vacuum forming or trimming operations. The slots 70 are slightly larger in size than the fingers 57, but smaller than the pads 54. The material sheet 27 will overlie the slots 70 so that when the lift arm assembly 37 is lowered, the bottom surfaces of the clamp pads 54 are pressed against the top surfaces of the outer scrap 32 above the slots 70 with the fingers 57 extending downwardly below the edges of the table 19. Thereafter, the fingers 57 can be driven to a closed position with the finger top surfaces or pads 56 pressed against the scrap bottom surface by extending the motors 60 so as to move the fingers 57 through the slots 70 by scissors action. As a result, material scrap portion 32 is positively gripped between the pads 54 and the pads 56 on fingers 57.

Slots could not readily be cut in the center portion 22 of the table 19 since the slots would interfere with the tolerances required during the vacuum forming and cutting operations. Therefore, a second portion of the gripping devices 45 is mounted on the underside 47 of the plate 43 and includes a stop 73 welded to the underside 47 of plate 43 and a fluid or air motor 75. As best seen in FIG. 3, the motor 75 has an air cylinder 77 welded to the underside 47 of the plate 43 and a rod 78 to which a blade 80 is fixed at the outer end thereof. The cylinder 77 is mounted slightly off center of the plate 43 so that when the lift arm assembly 37 is lowered with the motor 75 in retracted position, the blade 80 is aligned with the top surface of the inner table portion 22. When the lift arm assembly 37 is in fully lowered position, the plate 43 will be spaced from the table 19 and from the material sheet 27 by the arm segments 55 of the clamps 50 thereby giving the motor-driven blade 80 a small amount of working space in which to function. The motor 75 can thus be extended by admitting air through conduit 79 to move the blade 80 toward the stop 73 so as to gather up the inner scrap portion 33 and press it forcefully against the stop 73. The blade 80 is bent slightly to ensure that the scrap is removed from the table 19 and that the scrap is pinned securely between the blade 80 and the stop 73 and underside 47 of the plate 43. The motor 75 is retracted by admitting air through conduit 81.

Thus, when the clamps 50 are closed together and the blade 80 is closed against the stop 73, all of the scrap material, including outer and inner portions 32 and 33, is positively gripped and can be lifted away from the top of the vacuum chamber 16. Thereafter, the lift arm assembly 37 is moved via rotation of the spindle 40 to a selected position. The clamps 50 and the blade 80 are opened by driving the respective motors 60 and 75 to retracted positions thereby depositing the scrap materials 32 and 33 as desired into one of the plurality of scrap accumulating areas, two of which are shown as bins and designated 82 and 83 in FIG. 2.

The parts of the apparatus, such as the pads 54, pads 56 on fingers 57, stop 73 and blade 80, coming into contact with the uncured elastomeric material may be treated, coated or wrapped with a suitable material to prevent sticking.

INDUSTRIAL APPLICABILITY

The scrap removal apparatus 35 is particularly adapted for use in the vacuum forming process in making large tire carcasses. These tires often range from 50 to 100 inches in diameter or more. Two or more types of uncured rubber are used, tube stock placed as a first layer on the core and bond stock placed as a second layer. The process of building up these tires is substantially automated.

Initially, the sheet of elastomeric material is laid flat on the table 19. After the core 10 is raised and a portion of the rubber is cut and stitched to the core, the core is lowered whereupon the scrap removal apparatus 35 is moved into position to remove the scrap material from the outer edge portion 21 and from the center portion 22 of the table 19. The scrap removal apparatus 35 is designated to be remotely actuated in response to a programmed sequence of instructions from a data processing unit or computer. When the vacuum chamber 16 is moved from the trimming station, where the excess rubber sheeting was cut from the vacuum wrapped core 10, the scrap lies on the table 19 over which the lift arm assembly 37 will be positioned.

Programmed actuation causes the lift arm assembly 37 to descend until the clamp pads 54 contact the trimmed sheet portion 32. When proxmity switches indicate that the pads 54 have contacted the sheet, the motors 60 are actuated to extend the rods 64 thereby closing the gripping devices 45 to pin the scrap between the clamp ports 54,56 to positively grip the outer scrap material 32. Simultaneously, motor 75 extends rod 78 to clamp the center scrap 33 against the stop 73. When full clamping is signalled, the lift arm assembly 37 is tilted to the maximum height position and is pivoted away from and clears the outermost edge portions 21 of the table 19. The clamp fingers 57 pass upwardly through the table slots 70. Thereafter, the trim scrap 32,33 is released into one of the scrap accumulating areas 82 or 83 by retracting the motors 60 and 75. The swing and release action is programmed to drop the scrap at a selected site according to rubber composition so that it may be conveniently recycled.

Other aspects, objects and advantages of this invention can be obtained from a study of the drawings, the disclosure and the appended claims.

I claim:

1. In a device having a table (19) upon which scrap (32,33) to be removed lies, a scrap removal apparatus (35) comprising:

a lift arm assembly (37);

means (36) for supporting said lift arm assembly (37) and elevating and moving said lift arm assembly (37) between a first position adjacent and above the table (19) and at least one other position away from the table (19) where said scrap (32,33) may be deposited;

a plurality of clamps (50) carried by said lift arm assembly (37) adapted to grip a portion of the scrap (32), a table (19) having slots (70) defined at the edges thereof which the scrap (32) overlies and through which the clamps (50) are partially movable;

remotely actuable power means (60) for closing and opening said clamps (50) for gripping and releasing said scrap (32);

a blade (80) and a stop (73) are carried by said lift arm assembly (37); and a remotely actuable power means (75) is provided for moving said blade (80) toward and away from said stop (73), said blade (80) being moved toward said stop (73) to gather another portion of the scrap (33) and to hold said scrap (33) against said stop (73).

2. The scrap removal apparatus (35) as claimed in claim 1 wherein said lift arm assembly (37) includes a plate (43) mounting said clamps (50) adjacent the edges thereof and said blade (80) near the center thereof, said clamps (50) and said blade (80) and stop (73) extending below said plate (43).

3. In a device having a table (19) with separate inner and outer portions (22,21) on which material (27) is placed and is cut leaving an inner piece of scrap (33) on the inner table portion (22) and a separate outer piece of scrap (32) on the outer table portion (21), a scrap removal apparatus (35) comprising:

a lift arm assembly (37);

means (36) for supporting said lift arm assembly (37) and moving said lift arm assembly (37) between a first positon adjacent and above the table (19) and at least one other position away from the table (19);

a plurality of clamps (50) carried by said lift arm assembly (37) adapted to grip a portion of the outer scrap (32), the outer table portion (21) having slots (70) defined at the edges thereof over which the outer scrap (32) lies and through which slots (70) the clamps (50) are partially movable;

remotely actuable power means (60) for opening and closing said clamps (50);

a blade (80) and a stop (73) carried by said lift arm assembly (37); and remotely actuable power means (75) for moving said blade (80) toward said stop (73) along the inner table portion (22) so that said blade (80) gathers the inner scrap (33) and holds it against said stop (73).

4. The scrap removal apparatus (35) as claimed in claim 3 wherein said clamps (50) have an enlarged pad portion (54) and a finger portion (57), said pad portions (54) being of a size larger than said respective slots (70) and said finger portions (57) being of a size smaller than said respective slots (70).

5. The scrap removal apparatus (35) as claimed in claim 4 wherein said pad portions (54) have bottom surfaces which contact the top surface of the outer scrap (32) and said finger portions (57) have top surfaces which contact the bottom surface of said outer scrap (32) lying against the upper surface (28) of the table (19).

6. The scrap removal apparatus (35) as claimed in claim 3 wherein said lift arm assembly (37) includes a plate (43) for mounting said clamps (50) adjacent the edges thereof and mounting said blade (80) and stop (73) near the center thereof so as to overlie the inner table portion (22) when said lift arm assembly (37) is moved to said first position.

7. The scrap removal apparatus (35) as claimed in claim 4 wherein said clamps (50) and said blade (80) and stop (73) are mounted on the underside (47) of said plate (43), said plate (43) when said lift arm assembly (37) is moved to said first position being spaced above the table (19) to define a working space between said plate (43) and table (19) in which said blade (80) is movable.

8. The scrap removal apparatus (35) as claimed in claim 7 wherein said blade (80) is bent to assist in gathering scrap (33) from the table (19) and hold it against said stop (73) and the underside (47) of said plate (43).

9. The scrap removal apparatus (35) as claimed in claim 3 wherein said supporting means (36) includes means (44,46) for tilting said lift arm assembly (37) vertically and for moving said lift arm assembly (37) horizontally.

* * * * *